US009162155B2

(12) United States Patent
Platzer

(10) Patent No.: US 9,162,155 B2
(45) **Date of Patent: *Oct. 20, 2015**

(54) DEVICE FOR DETECTING, MONITORING AND/OR CONTROLLING RACING VEHICLES

(75) Inventor: Peter Platzer, Linz (AT)

(73) Assignee: Amusys Amusement Systems Electronics GmbH, Hoersching (AT)

( * ) Notice: Subject to any disclaimer, the term of this patent is extended or adjusted under 35 U.S.C. 154(b) by 292 days.

This patent is subject to a terminal disclaimer.

(21) Appl. No.: 13/816,372

(22) PCT Filed: Jul. 19, 2011

(86) PCT No.: PCT/EP2011/003619

§ 371 (c)(1),
(2), (4) Date: Feb. 11, 2013

(87) PCT Pub. No.: WO2012/019696

PCT Pub. Date: Feb. 16, 2012

(65) Prior Publication Data

US 2013/0143675 A1 Jun. 6, 2013

(30) Foreign Application Priority Data

Aug. 12, 2010 (DE) ..... 20 2010 011 318 U

(51) Int. Cl.
*A63H 18/16* (2006.01)
*B61L 25/00* (2006.01)
(Continued)

(52) U.S. Cl.
CPC ..... *A63H 18/16* (2013.01); *A63H 18/026* (2013.01)

(58) Field of Classification Search
CPC ..... A63H 18/16; A63H 18/026
USPC ..... 463/58–69, 6; 246/122 R; 104/60, 303
See application file for complete search history.

(56) References Cited

U.S. PATENT DOCUMENTS 4,183,056 A 1/1980 Evans et al.
5,140,307 A 8/1992 Rebetez et al.
(Continued)

FOREIGN PATENT DOCUMENTS

CN 2451194 10/2001
DE 3725227 2/1989
(Continued)

OTHER PUBLICATIONS

International Search Report for PCT/EP2011/003619, English translation attached to original, Both completed by the European Patent Office on Oct. 25, 2011, All together 7 Pages.

*Primary Examiner* — Sebastiano Passaniti
(74) *Attorney, Agent, or Firm* — Brooks Kushman P.C.

(57) ABSTRACT

A device for detecting, monitoring and/or controlling racing vehicles on a preferably multi-lane racetrack, having at least one sensor unit which is arranged countersunk under the surface of a carriageway. The at least one sensor unit is mounted on a guide element which can be inserted into a receptacle space under the carriageway in the transverse direction with respect to the carriageway, from the lateral edge of the carriageway. In this context, cables, lines or the like can be pre-assembled in a complete state with the at least one sensor unit and can be inserted under the carriageway from the side together with the guide element, with the result that there is no need for any separate laying of cables or even for a cable connection once the sensor is in position.

10 Claims, 2 Drawing Sheets

(51) Int. Cl.
*B60L 15/00* (2006.01)
*A63H 18/02* (2006.01)

(56) References Cited

U.S. PATENT DOCUMENTS

| | | | | |
|---|---|---|---|---|
| 5,461,924 | A * | 10/1995 | Calderara et al. | 73/786 |
| 5,666,101 | A | 9/1997 | Cazzani et al. | |
| 5,813,351 | A * | 9/1998 | Chen | 104/60 |
| 5,970,882 | A * | 10/1999 | Smith et al. | 104/60 |
| 6,189,838 | B1 * | 2/2001 | Nicolette et al. | 246/122 R |
| 6,542,183 | B1 | 4/2003 | DeAngelis et al. | |
| 6,545,705 | B1 | 4/2003 | Sigel et al. | |
| 7,102,670 | B2 | 9/2006 | Seaman et al. | |
| 7,285,035 | B1 * | 10/2007 | Tullis | 446/444 |
| 7,336,178 | B2 | 2/2008 | Le | |
| 7,448,626 | B2 * | 11/2008 | Fleckenstein | 273/149 R |
| 7,627,451 | B2 * | 12/2009 | Vock et al. | 702/178 |
| 2004/0067004 | A1 * | 4/2004 | Hill et al. | 385/13 |
| 2006/0183405 | A1 | 8/2006 | Mathews | |

FOREIGN PATENT DOCUMENTS

| | | |
|---|---|---|
| DE | 10336447 | 3/2005 |
| EP | 0949483 | 10/1999 |
| EP | 1967241 | 9/2008 |
| GB | 2382488 | 5/2003 |
| WO | 9953686 | 10/1999 |
| WO | 2006042235 | 4/2006 |

* cited by examiner

DEVICE FOR DETECTING, MONITORING AND/OR CONTROLLING RACING VEHICLES

CROSS-REFERENCE TO RELATED APPLICATION

This application is the U.S. national phase of PCT Appln. No. PCT/EP2011/003619 filed on Jul. 19, 2011, which claims priority to German Patent Application No. 20 2010 011 318.0 filed on Aug. 12, 2010, the disclosures of which are incorporated in their entirety by reference herein.

BACKGROUND

The present invention relates to a device for detecting, monitoring and/or controlling racing vehicles on a preferably multi-lane racetrack, having at least one sensor unit, which is arranged countersunk under the surface of a carriageway.

Such controlling and monitoring devices are used in particular on model racetracks, in particular those known as slot-car tracks, but may in principle also be used on real racetracks and the racing vehicles driving on them. Of course, various types of vehicle come into consideration here as racing vehicles, such as for example cars or motorcycles, but in principle other things that race, such as for example horses, sulkies or watercraft such as speedboats, may also be equipped with corresponding devices, so that the term racing vehicle should be understood in a broad sense in the context of the present application.

Racing on racetracks is usually monitored with the aid of technical means of detection and controlled by corresponding control modules, such as for example detection of the number of laps completed and/or lap time or the identification of a respective vehicle or a driver assigned to this vehicle. Apart from the monitoring measures already long known per se, such as light barriers for detecting the speed, camera monitoring for detecting the finish or the like, it has recently also already been proposed to monitor or control vehicles and the drivers controlling them as well as the position of the vehicle on the racetrack and the time or distance driven by electronic data transmission from the vehicle. For example, the documents WO 2006/042235 A2 and US 2006/0183405 A1 propose fitting on the racing vehicles so-called RFID elements, i.e. identification modules operating by radio data communication, and to store in these RFID elements a vehicle identification, a driver identification and possibly further vehicle and driver data as well as race data, which is then read by suitable RFID readers located at the racetrack, for example in such a way that each time the finishing line is passed the RFID element of a vehicle is read and the lap counter is correspondingly incremented and stored together with the vehicle and driver identifications.

In addition to the mentioned RFID readers, the cited document WO 2006/042235 A2 here proposes integrating conductor loops or light projectors into the racetrack, in order to detect vehicles driving over them.

However, such sensor systems countersunk under the surface of a carriageway cannot be integrated all that easily in the carriageway, in particular in the case of slot-car racetracks. In particular, maintenance or adjustment work that becomes necessary can only be performed with difficulty. If a sensor has to be removed, not only is removal laborious, but the exact positioning during installation that is necessary for satisfactory functioning of the sensor system is difficult to set. On the other hand, specifically in the case of slot-car tracks it must be taken into consideration that, depending on the base of the track and on how the carriageway is secured, vibrations may be introduced into the sensor system to a greater or lesser extent when it is driven over by the racing vehicles, which may adversely affect its measuring accuracy, but also its service life.

SUMMARY

The present invention is therefore based on the object of providing an improved device of the type mentioned at the beginning that avoids disadvantages of the prior art and develops the latter in an advantageous way. In particular, while being easy and quick to mount and maintain, it is intended to make it possible for the sensor system to be positioned exactly, and consequently for the racing vehicles to be detected precisely, without adversely affecting the space and racing on the racetrack.

This object is achieved according to the invention by a device as claimed in claim 1. Preferred configurations of the invention are the subject of the dependent claims.

It is therefore proposed not to fit the sensor system with its individual components into the carriageway from above or to mount it fixedly on the base structure before the carriageway is applied, or to secure it directly to the carriageway itself, but to premount the sensor system on a support and insert it under the carriageway from the side into a receiving space provided there. According to the invention, the at least one sensor unit is mounted on a guiding element, which can be pushed into a receiving space under the carriageway transversely in relation to the carriageway from the lateral edge of the carriageway. This allows cables, lines or the like to be ready premounted with the at least one sensor unit and inserted together with the guiding element under the carriageway from the side, so that there is no need for separate cable laying or even for cable connection to be left until the sensor is in position.

Advantageously, the sensor system under the carriageway is not in contact with it or is kept at a certain distance from the carriageway, so that no vibrations are introduced into the sensor system from the carriageway.

Premounting on a guiding element is of advantage in particular whenever a plurality of sensor units are used, for example for a plurality of lanes of the racetrack. In an advantageous development of the invention, a plurality of sensor units may be mounted on the guiding element at a predetermined spacing from one another, so that the respective sensor unit comes to lie exactly in position below the intended portion of carriageway when the guiding element with all the premounted sensor units is pushed under the carriageway. The predetermined mounting spacing of the sensor units on the guiding element may correspond in particular to a division of the carriageway into lanes, so that the sensor unit intended for each lane comes to lie under the respective lane. The spacing of the premounted sensor units may also correspond to the spacing of sensor windows introduced into the carriageway, which may advantageously be provided alongside, in particular directly alongside, lane contacts, by means of which the racing vehicles are supplied with power. The mentioned sensor windows may in this case be a delimited area in the carriageway within which the carriageway has an increased transmittance for the sensor signals and/or variables to be detected. In particular, the mentioned sensor windows may form viewing windows if the sensor unit comprises optical means of detection, as still to be explained.

To be able to position the sensor units exactly and find the predetermined sensor position easily, the guiding element and/or the mentioned receiving space under the carriageway may be provided with sliding guiding means, which laterally guide and/or position the guiding element in relation to the carriageway transversely to the pushing-in direction in which the guiding element is pushed under the carriageway. In a development of the invention, the guiding element may be given the form of a guiding rail, which is provided with at least one projecting guiding strip and/or with at least one groove-shaped guiding recess, with which complementary guiding means on the receiving space can be brought into engagement. The mentioned receiving space may advantageously be formed as a guiding shaft, the walls of which form at least in certain portions guiding faces on which the mentioned guiding rail is directed exactly into position under the carriageway.

The mentioned sensor unit may in principle be formed in various ways and have various means of detection, depending on which tasks the sensor system is intended to perform. In particular, according to an advantageous development of the invention, it may be provided that the sensor units respectively have optical means of detection, which look through viewing windows provided in the carriageway in order to be able to detect vehicles on the carriageway that are driving over the viewing window in the carriageway. The mentioned viewing window in the carriageway is advantageously closed by a light-transmissive element, for example a glass module or some other, for example plastic-containing, transparent closing element that withstands the forces usually acting on the carriageway. In principle, the mentioned viewing window could also be a carriageway clearance that is unclosed or only partially closed, for example by a grille. However, the viewing window is advantageously completely closed by a light-transmissive element, in order to protect the sensor system lying thereunder from dust, dirt and the like.

The mentioned viewing window in the carriageway and the mentioned sensor unit are made to match each other with regard to their position in such a way that the viewing window lies in the detecting axis of the optical means of detection.

In a development of the invention, the sensor unit has aligning means, delimiting the detecting direction and providing alignment in a predetermined direction. In particular, the sensor unit may have a signal input and/or output channel, which determines the detecting direction, is preferably aligned perpendicularly to the surface of the carriageway and/or is approximately cylindrical, only allows signals that are to be detected by the sensor unit to reach the means of detection of the sensor unit from a specific direction and/or only allows scanning signals that are emitted by the sensor unit to leave in a predetermined direction. Like an auditory canal or a tube predefining the viewing direction, the mentioned signal input and/or output channel can align the incoming or outgoing sensor signals exactly. Advantageously, the mentioned signal channel may consist of a tubular stub, at one end of which the means of detection of the sensor unit are arranged and the other end of which is directed toward the mentioned sensor window in the carriageway.

In a development of the invention, the mentioned optical means of detection may be variously formed, depending on which detection task is to be performed. For example, the optical means of detection may operate in the manner of a light barrier, in order for example to detect exactly the passing of a racing vehicle over the finishing line. In principle, the optical sensor may be variously formed here. In the manner of an active light barrier sensor, it may be provided that the sensor unit comprises a light source that casts light upwardly through the light window in the carriageway and only when a vehicle drives over the viewing window is this light reflected back through the viewing window in the carriageway by the vehicle, for example by a mirror attached to it on the bottom of the vehicle, and detected by the optical means of detection. Alternatively, such an optical sensor unit may also have only optical means of detection. If there is sufficient illumination of the racetrack, in particular from above, for example by carriageway lighting, the optical sensor under the viewing window in the carriageway detects a constant amount of light as long as no vehicle is driving over the viewing window. However, as soon as a vehicle drives over the viewing window, it becomes as it were darker under the viewing window, so that a dropout of the signal can be evaluated as the racing vehicle passing by.

Alternatively or in addition, the sensor unit may comprise an optical barcode reader. This allows in particular not only the passing of the vehicle to be detected but also the vehicle driving over the viewing window to be identified if the barcode, which is preferably attached to the bottom of the vehicle, includes a vehicle identification. Depending on which information the barcode attached to the vehicle contains, various evaluations can be carried out in addition to just the passing of the vehicle.

Alternatively or in addition, the at least one sensor unit may also have a receiving/reading device of another kind, in particular in the form of an RFID reader, for reading a vehicle memory attached to the vehicle. With the aid of such a receiving/reading device, more complex, more extensive or more complicated data that are stored on the vehicle can also be transmitted to the sensor unit or detected by it. In such a vehicle memory there may in particular also be stored a vehicle identification, in order to be able to identify the vehicle when it drives over the countersunk sensor unit.

According to an advantageous development of the invention, the sensor unit may have a plurality of means of detection, preferably variously formed, which interact with one another or are used in concert with one another. In particular, a sensor unit may have both optical means of detection of the aforementioned kind and an RFID reader and/or a barcode reader, in order to be able on the one hand to determine exactly the passing of the vehicle and on the other hand to identify the respective vehicle. Alternatively or in addition, further sensors, such as for example inductive sensors, may also be mounted on the mentioned guiding element, in order for example to be able to detect the approach to a further sensor unit or the distance from it.

In a development of the invention, the plurality of means of detection assigned to a lane are mounted together on the mentioned guiding element, so that the plurality of means of detection can be positioned, mounted and removed together in an easy way. As an alternative to this, it would also be possible to provide a plurality of guiding elements for the plurality of means of detection, in order when a means of detection is undergoing maintenance to be able to remove specifically only this one means. However, the arrangement of all the means of detection on a common guiding element is preferred, since in this way the positioning of the means of detection in relation to one another is precisely predefined.

A control device which predefines a temporal receiving/reading window for the receiving/reading device, to be precise in dependence on a signal of the further means of detection, may advantageously be provided here. For example, the temporal detecting or reading window for the RFID reader may be opened or predefined when the passing of a vehicle is reported by the optical sensor. This provides an easy way of preventing the data of a vehicle memory that is attached to the vehicle passing by on the neighboring lane from being read by the RFID reader, for example as a result of an excessive detection range.

BRIEF DESCRIPTION OF THE DRAWINGS

The invention is explained in more detail below on the basis of a preferred exemplary embodiment and associated drawings, in which.

DETAILED DESCRIPTION

Figure 1:
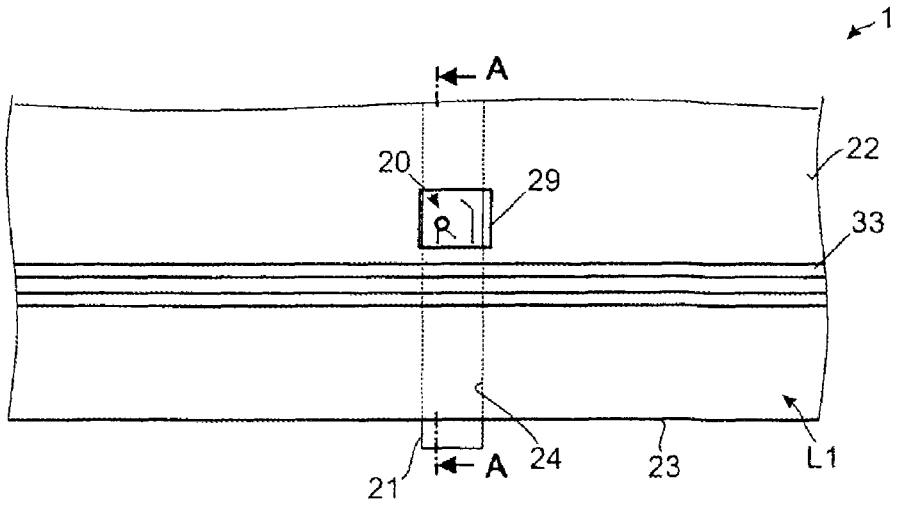
FIG. 1 shows a schematic plan view of a lane of a racetrack, which shows the sensor window arranged alongside the lane contacts of the carriageway and the countersunk sensor unit arranged thereunder.

The detail of a racetrack 1 that is represented in FIG. 1 shows the carriageway 22 of a lane L1 of a slot-car track, in which the lane contacts 33 known per se are countersunk in order to supply racing vehicles driving on it with power. Although only one lane L1 is represented, it goes without saying that the racetrack 1 may have a plurality of lanes arranged alongside one another.

As FIG. 1 shows, provided in the base structure under the carriageway 22 is a receiving space 24, extending transversely to the mentioned carriageway 22 and in the form of a receiving shaft, into which the sensor system for monitoring the racing vehicles driving on the carriageway 22 can be pushed.

Figure 2:
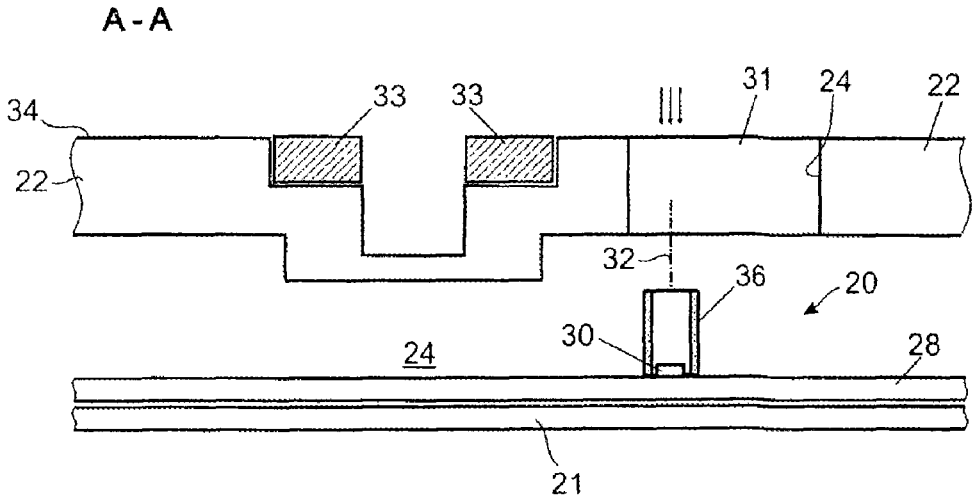
FIG. 2 shows a sectional view through the carriageway of the racetrack and the sensor unit lying thereunder along the line A-A in FIG. 1, showing the sensor window in the carriageway alongside the lane contacts and, of the sensor unit lying under the carriageway, the guiding rail, the circuit board mounted on it and the sensor unit mounted in turn on that, FIG. 3 shows a cross section through the guiding rail and the sensor unit secured thereon from FIG. 2.
Figure 3:
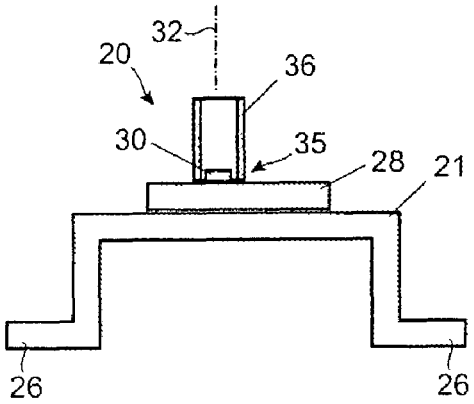
Figure 4:
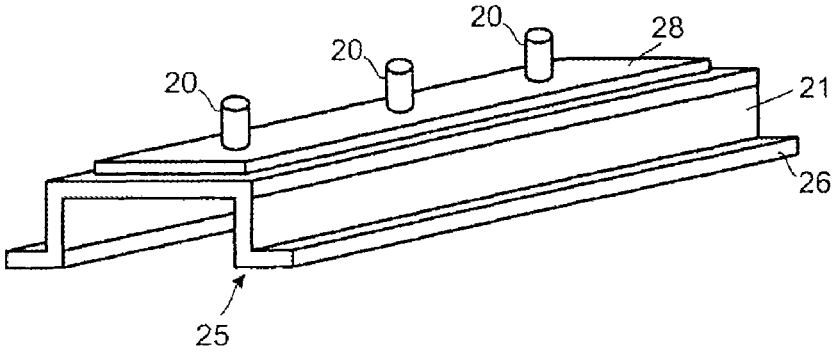
FIG. 4 shows a schematic, perspective view of the guiding rail with the circuit board mounted thereon and the sensor unit secured thereto for monitoring a plurality of lanes of a multi-lane racetrack.

As the further FIGS. 2-4 show, provided here as a support for the sensor system is an elongate guiding element 21, which in the embodiment depicted is formed as a guiding rail in the form of an extruded profile. The mentioned guiding rail has in the embodiment depicted a step- or pedestal-shaped cross section and comprises laterally projecting guiding strips 26, which serve as sliding guiding means 25, in order to position the guiding rail exactly when pushing the guiding element 21 into the receiving space 24. The mentioned receiving space 24 is adapted in cross section to the profile of the guiding element 21 or provided with adapted sliding guiding means, so that interacting guiding surfaces or elements enter into engagement and position the guiding rail exactly transversely to its longitudinal direction.

In the present exemplary embodiment, secured on the mentioned guiding element 21 is a circuit board 28, which rests with its back side on the upper side of the mentioned rail profile, cf. FIGS. 3 and 4.

Figure 5:
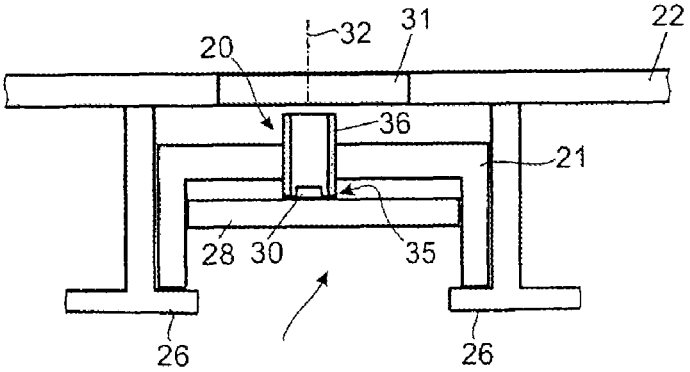
FIG. 5 shows a cross section similar to FIG. 2 through the guiding rail according to a further advantageous embodiment of the invention, in which the sensor unit with the associated circuit board is mounted on the underside of the guiding rail.

As an alternative to the embodiment that is shown in FIGS. 3 and 4, in an advantageous development of the invention the circuit board 28 with the sensor system secured thereto may also be mounted on the mentioned rail profile from below, so that the electronics are better protected. As FIG. 5 shows, the mentioned circuit board may in particular be received between the legs of the U-shaped rail profile, so that the circuit board 28 as it were looks with its upper side at the underside of the middle portion of the guiding rail.

The said circuit board 28 in turn carries a number of sensor units 20, which are arranged spaced apart from one another in the longitudinal direction of the rail. The spacing of the sensor units 20 from one another advantageously corresponds here to the spacing of the lanes or the spacing of the lane contacts 33 of various lanes of the racetrack 1, so that the sensor units 20 can be positioned exactly in position alongside the mentioned lane contacts 33 under the carriageway 22, as FIG. 2 shows.

The circuit board 28 may in this case be formed entirely as one part or else as more than one part.

In the embodiment depicted, the sensor units 20 respectively comprise optical means of detection 30 in the form of a photosensor, which has been applied directly on the mentioned circuit board 28 and connected to the conductor tracks thereof.

The mentioned photosensor may be formed as a photoresistor or as a photodiode or as a phototransistor, which operates by utilizing the interior photoelectric effect, or as a photocell or photomultiplier or as a pyroelectric sensor, which operates by utilizing charge shifts caused by the change in temperature when light is absorbed.

As FIG. 2 and FIG. 3 show, fitted here over the mentioned photosensor is a light channel 36, which as it were delimits and predefines the viewing region of the photosensor and determines the detecting axis 32 of the photosensor. The mentioned light channel 36 extends perpendicularly to the plane of the circuit board 28 and in the mounted state perpendicularly to the carriageway surface 34. In the case of the embodiment that is shown in FIG. 5, the mentioned light channel 36 has been led through a corresponding clearance in the guiding element 21, since, as explained, the circuit board 28 is mounted there on the underside of the rail profile. In particular, the mentioned clearance in the guiding element 21 may be adapted exactly in position to the outer contour of the light channel 36, whereby the mentioned light channel 36 is guided or held on the guiding element 21, so that the securing of the sensor system to the guiding element 21 is improved. A frictionally engaging or material-bonding connection, for example by adhesive bonding, may possibly also be provided here for further improvement of the securing of the light channel 36. A light channel 36 secured in this way to the guiding element 21 serves at the same time as protection for the photosensor.

Incorporated in the carriageway 22 alongside the lane contacts 33 are sensor windows 29, which are closed by light-transmissive elements 31, cf. FIG. 2. The mentioned sensor units 20 are arranged under the carriageway 22 such that the detecting axis 32 of the sensor units 20 passes through the mentioned sensor windows 29.

The premounted unit comprising the common guiding element 21 and the sensor units 20 mounted thereupon can be pushed from the edge 23 of the carriageway transversely to the carriageway 22 under it, the sensor units 20 coming to lie exactly in position under the carriageway 22 in the region of the sensor windows 29, as FIG. 2 shows.

With the mentioned optical means of detection 30, it can be detected in the way described at the beginning whether and when a racing vehicle drives over the sensor window 29. Depending on the form of the optical means of detection 30, further information may also be detected. If the mentioned optical means of detection 30 are formed as a barcode reader 35, a barcode attached to the bottom of the vehicles can be detected.

The barcode reader 35 may be formed as a CCD scanner, with which a flat line segment of the barcode can be detected all at once in its entire width. For this purpose, the code is lit up by light-emitting diodes. Depending on the brightness or darkness, the barcode is reflected onto a CCD or photodiode line. A detector decodes from this the lines and gaps of the barcode, and consequently the information contained therein.

The barcode reader 35 may be formed as a laser scanner, it being possible for one or more laser beams to be directed onto the barcode and made to pass in a linear form at high speed over the barcode by means of an oscillating mirror, a mirror wheel or other optical systems. The light reflected more strongly or weakly from the barcode by the light and dark lines is then detected by an optical system and converted into electrical signals by means of a photodiode and evaluated.

Alternatively or in addition, so-called RFID readers or barcode readers may also preferably be mounted on the circuit board 28, in order to be able to read an RFID chip or barcode secured to the vehicles when the vehicles drive over the sensor window 29. Advantageously, the reading operation may be initiated here when the driving over of a vehicle is detected by the optical means of detection 30. Alternatively or in addition, further sensors, such as for example inductive sensors, may also be attached on the mentioned circuit board 28, in order to be able to detect the approach or distance of the vehicles. Such further sensors may in particular be positioned ahead of and/or behind the mentioned optical means of detection 30, as seen in the driving direction.

The invention claimed is:

1. A device in combination with a multi-lane racetrack that includes a plurality of racing vehicles, the racetrack being provided with a carriageway, the device comprising:

a carriageway section having a lateral edge and a receiving space bounded by a wall that is arranged transversely in relationship to said lateral edge, the receiving space being defined in a countersunk portion under the carriageway section;

the carriageway section further comprising a sensor window being a delimited area in the carriageway section; each said vehicle being provided with a vehicle memory that can be detected by at least one sensor unit; said device including said at least one sensor unit for detecting, monitoring and/or controlling said plurality of racing vehicles on said multi-lane racetrack; the sensor unit being arranged on a guiding element, which is sized to fit into said receiving space under the carriageway section such that the at least one sensor unit is free from contact with the carriageway of the racetrack.

2. The device as claimed in claim 1, wherein the said at least one sensor unit is mounted on a circuit board that forms at least part of a guiding element or is rigidly fastened to the guiding element which is mounted within the carriageway receiving space.

3. The device as claimed in claim 1, a plurality of sensor units being mounted on the guiding element at a predetermined spacing from one another, the spacing of the sensor units corresponding to a division of the carriageway section into lanes (L1, L2, Ln) and/or the spacing of sensor windows provided in the carriageway section.

4. The device as claimed in claim 1, the at least one sensor unit having optical means of detection and the sensor window forming a viewing window that is closed by a light-transmissive element and is arranged in a detecting axis of the optical means of detection.

5. The device as claimed in claim 4, the sensor window being arranged in the carriageway section alongside lane contacts for supplying the racing vehicles with power.

6. The device as claimed in claim 1, wherein the at least one sensor unit having a signal input and/or output channel, which determines a detecting direction of the sensor unit and which is aligned generally perpendicularly to the surface of the carriageway section and is approximately cylindrical.

7. The device as claimed in claim 1, the sensor unit comprises a barcode reader.

8. The device as claimed in claim 1, the sensor unit having a receiving/reading device, in the form of an RFID reader, for reading a vehicle memory provided on the racing vehicle.

9. The device as claimed in claim 8, a control device being provided for predefining a temporal receiving/reading window for the receiving/reading device in dependence on a signal from the sensor unit.

10. A device in combination with a multi-lane racetrack that includes a plurality of racing vehicles, the racetrack being provided with a carriageway having a lateral edge and a receiving space bounded by a wall that is arranged transversely in relationship to said lateral edge, the receiving space being defined in a countersunk portion under the carriageway; each said vehicle being provided with a vehicle memory that can be detected by at least one sensor unit;

said device including said at least one sensor unit for detecting, monitoring and/or controlling said plurality of racing vehicles on said multi-lane racetrack; the sensor unit being arranged on a guiding element that can be pushed into said receiving space under the carriageway; the guiding element and/or the receiving space having sliding guiding means for lateral guiding and/or positioning transversely to the pushing in direction of the guiding element into the receiving space; the guiding element structured as a guiding rail with at least one projecting guiding strip and/or at least one groove-shaped guiding recess and/or the receiving space being formed as a guiding shaft with portions of the wall forming said sliding guiding means;

said at least one sensor unit being arranged on said guiding element such that the at least one sensor unit is free from contact with the carriageway of the racetrack when the guiding element is pushed into the receiving space and the at least one sensor unit being kept at a distance from the carriageway in the countersunk; said at least one sensor unit being mounted on a circuit board that forms at least part of the guiding element and/or is rigidly fastened to the guiding element.

* * * * *